United States Patent [19]

Simmonds, Jr. et al.

[11] 4,436,771

[45] Mar. 13, 1984

[54] METHOD OF LASTING SHOES

[75] Inventors: Robert C. Simmonds, Jr., Boxford; Andrew J. Gilbride, Swampscott, both of Mass.

[73] Assignee: USM Corporation, Farmington, Conn.

[21] Appl. No.: 469,503

[22] Filed: Mar. 2, 1983

[51] Int. Cl.[3] ..... A43D 29/00

[52] U.S. Cl. ..... 427/284; 12/145; 427/358

[58] Field of Search ..... 12/145; 427/284; 427/358

*Primary Examiner*—Bernard D. Pianalto

*Attorney, Agent, or Firm*—Donald N. Halgren

[57] ABSTRACT

For applying adhesive, for lasting shoes from the toe end at least over ball region of the shoe, an imprinter plate and nozzles are used, the region in which adhesive is applied by the imprinter plate extending from the toe end of the shoe and lying within, but being substantially smaller than, the region inwiped by the toe wiper plates. The nozzles, which can be guided by computer control means according to the particular style and size of shoe, are thus also used to apply adhesive to the heelward part of the region inwiped by the wiper plates as well as beyond such region. The invention is thus applicable to both combined toe and side lasting operations as well to extended forepart lasting over the ball region of the shoe.

6 Claims, 1 Drawing Figure

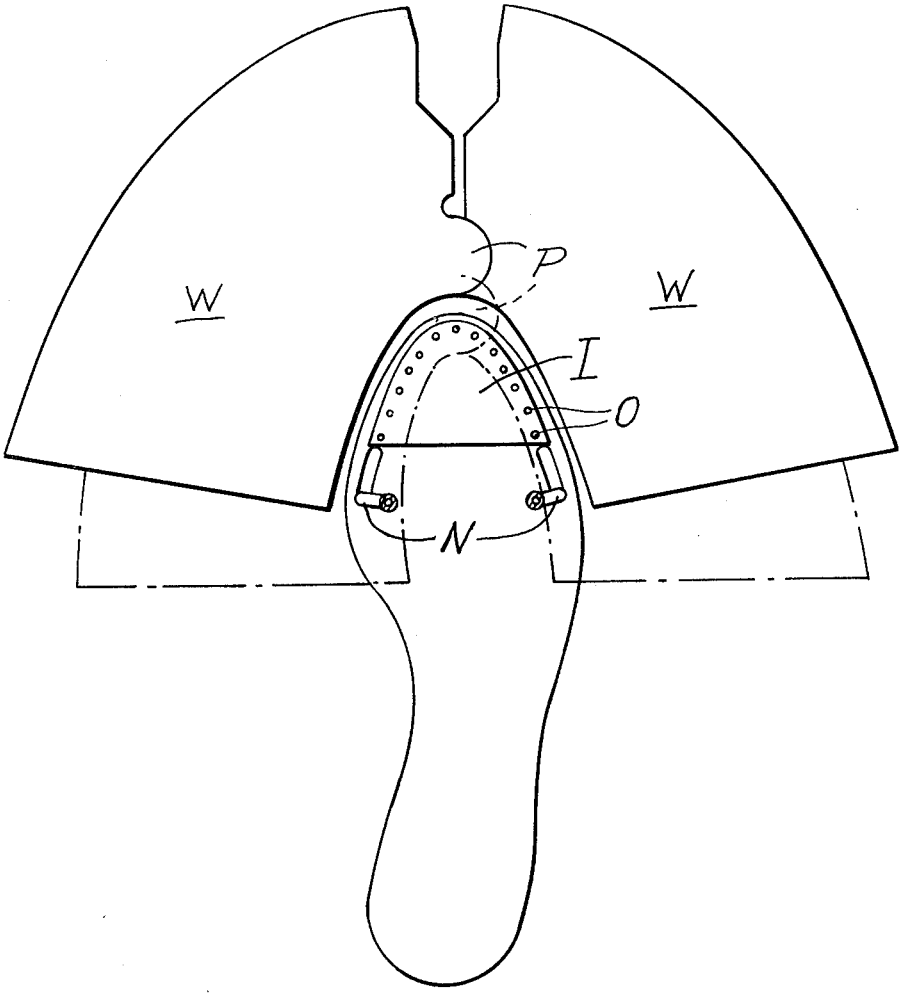
W
W
P
I
O
N

METHOD OF LASTING SHOES

BACKGROUND OF THE INVENTION (1) Field of the Invention

The present invention is concerned with a method of lasting shoes, using adhesive, from the toe to at least over the ball region thereof, wherein the toe and forepart region of the shoe is inwiped by means of a pair of wiper plates mounted for inwiping movement about a common pivot located at or adjacent the toe end of the shoe, and wherein the adhesive is applied partly by means of an imprinter plate which is pressed against the shoe bottom and partly by nozzles movable along opposite sides of the shoe.

(2) Prior Art

Such a method is described in, for example, U.S. Pat. No. 3,399,411. In carrying out this method, the region to which adhesive is applied by the imprinter plate extends substantially co-extensively with the region inwiped by the pair of wiper plates. Furthermore, for any change of wiper plates, e.g., for changes in the style of the shoe or indeed in some circumstances for changes in size, it is considered necessary to change also the imprinter plate in order to ensure that the wiper plates properly co-operate with the imprinter plate, and for example to avoid any risk of collision as the wiper plates move into engagement with the shoe. This is especially desirable, but not exclusively so, where the wiper plates are first brought into an intermediate position, while the insole continues to be pressed against the last bottom, as described e.g., in our U.S. Pat. No. 3,579,691.

It is, however, generally the case that the toes of shoes fall within a relatively small number of what may be termed "generic" styles, e.g., rounded pointed, square. What is more, in most cases within each generic style, the toe region, i.e., the region closely adjacent the toe end of the shoe end extending only a relatively short distance therefrom, does not vary significantly between individual styles.

SUMMARY OF THE INVENTION

It is therefore the object of the present invention to provide an improved method of lasting shoes, in carrying out which method the region to which adhesive is applied by the imprinter plate is maintained standardized for a generic style, regardless of changes of the area inwiped by the wiper plates for each individual style.

This object is resolved in accordance with the invention in that, in a method as set out in the first paragraph above, the region to which adhesive is applied by means of the imprinter plate extends from the toe end of the shoe and lies within, but is substantially smaller than, the region inwiped by said pair of wiper plates.

It will thus be appreciated that by this method it is possible to use an imprinter plate which, because it covers only a portion of the region inwiped by the wiper plates, can be used in combination with more than one set of such wiper plates, the nozzles then being used for applying the adhesive in the region no longer covered by the imprinter plate as well as beyond such area.

It has furthermore been found especially advantageous where the region to which adhesive is applied by the imprinter plate extends approximately 50 mm (2") measured from the toe of the shoe, along the longitudinal center line of the toe region of the shoe. Where the imprinter plate is so dimensioned, it is considered to be suitable for use with at least the great majority of individual styles within a generic style, thus rendering it necessary to provide only one such plate for each generic style. What is more, where the imprinter plate also serves to hold the insole against the last bottom during an intitial inwiping stage of the wiper plates, an imprinter plate of such size has been found to be nevertheless adequate.

Preferably the nozzles apply adhesive starting adjacent the imprinter plate and being moved progressively heelwards therefrom. Furthermore, the method in accordance with the invention has been found especially advantageous where the nozzles apply adhesive along the side portions of the shoe up to the heel breast region thereof.

It will of course be appreciated that, while the imprinter plate can be considered as "standardized", the path of movement of the nozzles, in carrying out the method in accordance with the invention has to be controlled according to the individual size and style of shoe to be lasted. To this end, therefore, preferably the nozzles are guided along the shoe bottom by control means according to a pre-programmed set of parameters appropriate to the size and style of shoe to be lasted. More particularly, conveniently the control means comprises a computer which, in accordance with a selected set of digitized co-ordinate axis values stored in memory means associated with said computer, supplies control signals to n.c. motors (as herein defined) by which the nozzles are moved along the side portions of the shoe.

The term "n.c. motor" where used herein to be understood as a motor the operation of which is controlled by pulses supplied thereto in accordance with digitized information appropriate to the desired operation of the motor. Where two motors operate in conjunction with one another, e.g., to move a tool along a desired path, the digitized information is usually in the form of digitized co-ordinate axis values. Examples of such motors are stepping motors and d.c. servomotors.

BRIEF DESCRIPTION OF THE DRAWING

There now follows a detailed description, to be read with reference to the accompanying drawing, of one method of lasting shoes in accordance with the invention. It will be appreciated that this method has been selected for description by way of non-limiting example only.

In the accompanying drawing, there is shown a schematic view of a shoe bottom, indicating the regions thereof to which adhesive is applied respectively by an imprinter plate and by nozzles and also the region inwiped by a pair of wiper plates.

DETAILED DESCRIPTION OF THE PREFERRED EMBODIMENT

The method in accordance with the invention now to be described is a method of lasting shoes, more especially of lasting toe, forepart and side regions of shoes. Conventionally the toe and forepart regions of shoes are today lasted by so-called pulling over and toe lasting machines, while the side portions are thereafter lasted by so-called side lasting machines. However, it has been proposed to combine these operations in a single machine: see e.g., European Patent Application No. 81305977.1 (Publication No. 0055107). It is intended that the present invention will be carried out in such a combined machine suitably modified for the purpose.

Thus in carrying out this method in accordance with the present invention, the shoe to be lasted, comprising a shoe upper on a last and an insole on the last bottom, is placed, bottom down, on a shoe support and the margin of the upper is located in a plurality of grippers arranged around the shoe support in conventional manner. The upper is then tensioned over its last, against as is conventional, and a pair of wiper plates W mounted for inwiping movement about a common pivot P located at or adjacent the toe end of the shoe, are brought into an intermediate position in which they trap the upper against the margin of the insole, the grippers at the same time releasing their grip and also a toe band being applied to press the upper against the last immediately above the wiper plates. Again such a method is described in the aforementioned European Patent Application.

In this position two nozzles N are brought into engagement with the shoe bottom and also an imprinter plate I. The imprinter plate I extends from the toe of the shoe heelwardly approximately 50 mm (2"), as measured along the longitudinal center line of the toe region of the shoe; that is to say, the plate I, and thus the region of the insole covered thereby, is substantially smaller than the region to be inwiped subsequently by the wiper plates W. The imprinter I has an arrangement of orificii O which receives adhesive from pressurizable adhesive supply means, not shown, and discharges it therethrough to the insole, upon receipt of a proper signal.

The nozzles N are caused to move heelwardly, from a position adjacent the imprinter plate I, as shown in the drawing, along opposite sides of the shoe bottom, in a manner substantially as described in the aforementioned European Patent Application, that is to say, the nozzles N are guided by computer control means supplying drive signals to suitable n.c. motors (as herein defined), in accordance with a set of digitized co-ordinate axis values stored in suitable memory means associated with the computer, such set being selected according to the style of shoe being operated upon and modified according to the size of such shoe. (This size may conveniently be measured by the movement of a heel rest against the shoe, as described in the aforementioned European Patent Application).

In carrying out the method in accordance with the invention, as soon as the nozzles N have passed beyond the region to be inwiped by the wiper plates W, the latter are caused to continue their inwiping movement to a position as shown by the dashed lines in the drawing. Such further movement is controlled by the computer control means, which is also effective to ensure that the imprinter plate I is moved out of engagement with the insole so as to avoid any risk of collision of the wiper plates W with the imprinter plate I, as described in the aforementioned U.S. Pat. No. 3,579,691.

The side lasting of the shoe can take place, in carrying out the method in accordance with the invention, using any suitable conventional means. For example, as in the machine described in European Patent Application, lasting rolls may be used. Alternatively conventional lasting fingers or lasting bands may be used, in which case, side lasting can take place only after the nozzles N have completed their movement. Again within the scope of the present invention is included a method in which a shoe is lasted from the toe over the ball region only in carrying out such a method conventional ball wipers linked to the wiper plates may be used.

Although in carrying out the method described above the wiper plates are arrested in an intermediate position, whereafter the application of adhesive takes place, it is to be understood that in carrying out other methods in accordance with the invention the application of adhesive can take place before any inwiping movement of the wiper plates is initiated.

We claim:

1. Method of lasting shoes, using adhesive, from the toe to at least over the ball region thereof, wherein the toe and forepart region of the shoe is inwiped by means of a pair of wiper plates mounted for inwiping movement about a common pivot located at or adjacent the toe end of the shoe, and wherein the adhesive is applied partly by means of an imprinter plate which is pressed against the shoe bottom and partly by nozzles movable along opposite sides of the shoe, characterized in that the region to which adhesive is applied by means of the imprinter plate extends from the toe end of the shoe and lies within, but is substantially smaller than, the region inwiped by said pair of wiper plates.

2. Method according to claim 1, characterized in that the region to which adhesive is applied by the imprinter plate extends approximately 50 mm (2") from the toe of the shoe, measured along the longitudinal center line of the toe region of the shoe.

3. Method according to claim 1, characterized in that the nozzles apply adhesive starting adjacent the imprinter plate and being moved progressively heelwards therefrom.

4. Method according to claim 3, characterized in that the nozzles apply adhesive along the side portions of the shoe up to the heel breast region thereof.

5. Method according to claim 1, characterized in that the nozzles are guidable along the shoe bottom by a control means according to a pre-programmed set of parameters appropriate to the style of shoe to be lasted.

6. Method according to claim 5, characterized in that the control means comprises a computer which, in accordance with a selected set of digitized co-ordinate axis values stored in memory means associated with said computer, supplies control signals to n.c. motors (as herein defined) by which the nozzles are moved along the side portions of the shoe.

* * * * *